United States Patent [19]

Motten, Jr. et al.

[11] 4,050,045

[45] Sept. 20, 1977

[54] FINNED HEAT SINK FOR FUSE BLOCKS

[75] Inventors: Roger Henwood Motten, Jr.; Larry Paul LaFreniere, both of Bowling Green, Ohio

[73] Assignee: Marathon Electric Manufacturing Corporation, Wausau, Wis.

[21] Appl. No.: 723,028

[22] Filed: Sept. 13, 1976

[51] Int. Cl.[2] ..... H01H 85/02

[52] U.S. Cl. ..... 337/187; 337/166; 337/414

[58] Field of Search ..... 337/166, 186, 187, 203, 337/231, 250, 414; 200/306; 339/112 R

[56] References Cited

U.S. PATENT DOCUMENTS

| | | | |
|---|---|---|---|
| 3,710,295 | 1/1973 | Staub et al. | 337/166 |
| 3,713,065 | 1/1973 | Brichant | 337/166 |
| 3,736,544 | 5/1973 | Fluder | 337/414 X |
| 3,810,063 | 5/1974 | Blewitt | 337/166 |
| 4,011,537 | 3/1977 | Jackson, Jr. et al. | 337/186 X |

*Primary Examiner*—George Harris

*Attorney, Agent, or Firm*—Andrus, Sceales, Starke & Sawall

[57] ABSTRACT

A fuse holder of the type having a heat sink consisting of a plurality of specially spaced and constructed vertically extending fins located in the area where the heat generated by the fuse and/or the heat generated in the material of a wire connector or block itself is dissipated between the fuse and the location where the electrical wires enter the connector or block.

7 Claims, 4 Drawing Figures

FINNED HEAT SINK FOR FUSE BLOCKS

BACKGROUND OF THE INVENTION

Advances in fuse technology have provided fuses which are much reduced in size. Because of the smaller size, the heat generated by the fuse is greater than normally generated in conventional fuses and the connector block must dissipate a greater amount of heat. The invention overcomes the problem by use of a heat sink consisting of one or more vertically extending fins which are strategically constructed and located to dissipate the heat which is generated.

SUMMARY OF THE INVENTION

A fuse or connector block of insulating material has secured thereto under one embodiment of the invention two metal connectors which are spaced sufficiently apart to receive therebetween a fuse which has flat metal tangs projecting from each end. The tangs are each secured to opposite connectors. Conical pressure washers are used beneath the heads of the screws which are threaded through the tangs and into the connectors. Each connector has one or more upright, horizontally spaced fins of a critical height, width and spacing which are located between the fuse fastening screw and the securing screws or screws which secure the electrical wires in place after they have been inserted in the connectors. In some cases it is desirable that a plurality of horizontal spaced fins extend downwardly inside the body of each connector to dissipate the heat which is generated by the fuse. Fuses of varying capacity may be employed.

The heat sink construction may be used with one or more electric lines or cables connected to the connectors or a distribution fuse type fuse block or with any construction where a fuse would be employed.

The invention is specially directed for use with miniaturized fuses such as T-fuses or any fuse where heat generation is a problem. Incoming wires into a fuse holder are temperature rated, and it is required to dissipate a sufficient amount of heat in the connector to reduce the temperature at the wire termination to approved standards and/or codes.

Figure 1:
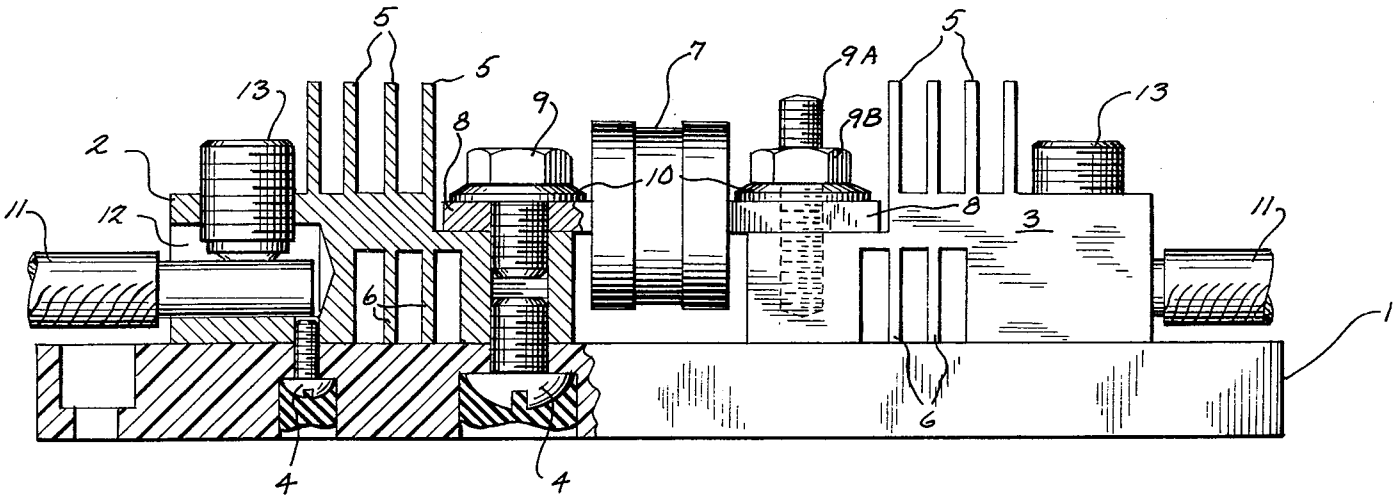
FIG. 1 is a side elevational view with parts in section illustrating a fuse holder for a 400 amp fuse and fins extending upwardly and downwardly from the connectors.

Referring to the drawings, there is shown an insulating block 1 which may be secured to a supporting surface, not shown, upon which is mounted a pair of wire connectors 2 and 3. The connector 2 is shown as secured to flat block 1 on the left side of FIG. 1 by screws 4 and connector 3 on the right side of FIG. 1 is similarly secured to block 1 by corresponding screws, not shown. The connectors 2 and 3 are mounted in horizontally spaced relation to each other.

Connectors 2 and 3 may be formed of aluminum and/or copper and formed at the same time and integrally therewith are the vertically spaced fins 5 which project upwardly from each connector. In some cases corresponding spaced fins 6 may be extended downwardly inside the connectors 2 and 3, and these may be seen in section and in elevation in FIG. 1.

The fins 5 and 6 are approximately one-sixteenth of an inch wide and are spaced apart from approximately 3/16 to 7/32 of an inch. Fins 5 and 6 also extend across the width of the respective connectors 2 and 3. For purposes of illustration, only four upwardly extending fins 5 are shown in FIG. 1, and two downwardly extending fins 6 are illustrated.

The short fuse 7 is shown as mounted in the space between connectors 2 and 3 and has flat tangs 8 extending from each side which overlap the upper surface of each connector and extend almost to fins 5. Tangs 8 are secured to the top of connectors 2 and 3 by screws 9 which have generally large bolt heads and are threaded into the body of the connector or studs **9*a* and nut 9*b*. The cone-shaped washers 10 are disposed beneath the heads of screws 9 and nut 9*b* to provide a tight tension connection between the connectors 2 and 3 and screw heads under changing conditions of heating and cooling of these parts. When fuse 7 is in place, fins 5 and 6 extend to a horizontal plane, respectively, which is spaced vertically outwardly, as illustrated in the drawings, from a horizontal plane extending through the horizontal center line of fuse 7**.

Figure 2:
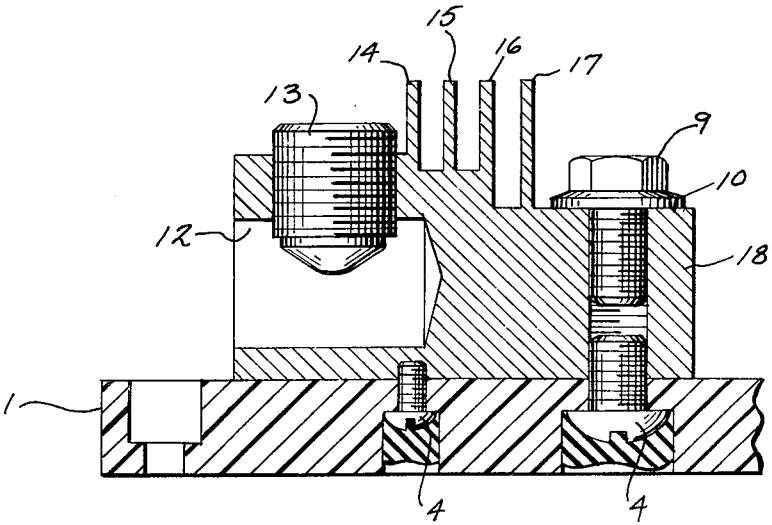
FIG. 2 is a detail sectional view of another form of the invention.

In the illustration of FIGS. 1 and 2, fuse 7 is of 400 amps and two wires 11 extend into openings 12 in the opposite outer ends of connectors 2 and 3. The wires are pressure connected against the inner wall of connectors 2 and 3 by the screws 13.

The fins 5 and 6 form a heat sink to dissipate heat from the connectors. The temperature rise of fuse 7 itself may be considerable under present standards and/or codes, but the temperature at connectors 5 and 6 at the area where wires 11 enter connectors 2 and 3 must be less to meet the standards and/or codes. Therefore, it is necessary to dissipate considerable heat in the connectors in the confined material between where the wires 11 enter connectors 2 and 3 and the fuse 7. The fins 5 and 6 effectively operate to dissipate the heat from the described confined area and the use of fins 5 and 6 reduces the overall length of the fuse holder. Present and proposed standards require that degrees of heat between 25° C to 35° C must be dissipated.

The number of fins 5 and 6 employed depends upon the amp fuses required for the particular service. For example, 400 amp and 600 amp fuses have been found to require four fins, while 200 amp needs two fins, and a 100 amp fuse only one fin.

FIG. 2 illustrates a detailed section of a connector which has a stepped type of construction, and four fins 14–17 are shown extending upwardly from the body of the connector 18. While FIG. 2 shows a stepped construction, any topography or number of fins of the general cross sectional area can be employed to accommodate various fuse designs. Fin 14 extends from the top step of connector 18. Fins 15 and 16 extend from the next down step of the connector 18, and fin 17 projects from the lower step of connector 18. The fins 14–17 are of varying height and in the embodiment illustrated in FIG. 2, terminate at the top in the same horizontal plane.

Figure 3:
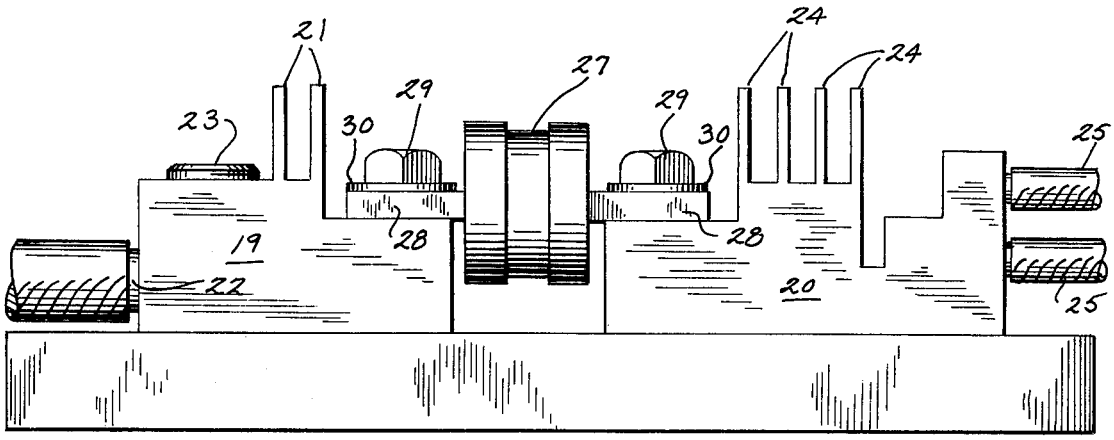
FIG. 3 is a side elevational view of a fuse holder employed with a distribution type fuse block.
Figure 4:
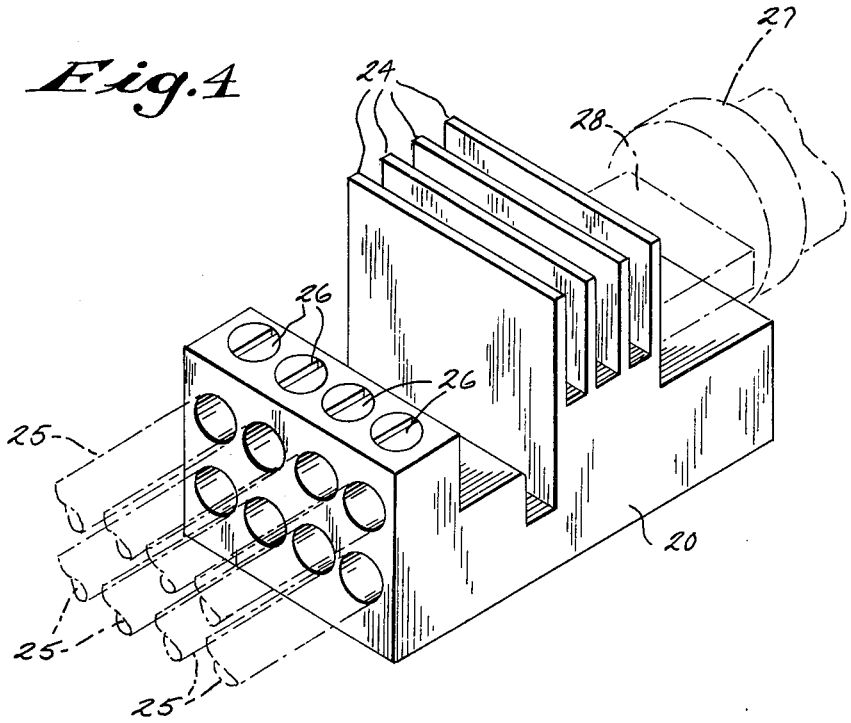
FIG. 4 is a perspective view looking from the right side of the distribution block of FIG. 3.

FIGS. 3 and 4 illustrate an embodiment of the invention employed with a distribution block.

A connector block 19 is shown at the left side of the FIG. 3 and the distribution block 20 is illustrated at the right side of FIG. 3, both of which are secured to the support block 1.

This embodiment illustrates the use of a pair of spaced fins 21 on connector 19 and each extends upwardly the same distance from the upper surface of the connector and across connector 19 and are spaced from each other the same as described with respect to fins 5 of the first embodiment. Fins 21 are integrally formed at the same time connector 19 is formed to the configuration of the stepped construction shown in the drawings.

An electrical wire 22 is inserted into the connector 19 and held by screw 23, as previously described.

The distributor block 20 has a stepped configuration and from the body of block 20, four fins 24 are shown of equal height which extend upwardly the same distance. Fins 24 are integrally extruded with the block 20. The fins 24 are spaced and of a width the same as the fins 5 of the first embodiment and likewise extend across the width of block 20.

A plurality of wires 25, in this case eight in number, extend into block 20 and are held within block 20 by the plurality of screws 26.

The fuse 27 is located between connector 19 and the distributor block 20 and has the flat tangs 28 on opposite sides which overlie connector 19 and block 20 and are secured to these members by the screws 29 which overlie the conical-shaped washers 30.

Under the construction of the invention, if the fuse needs to be replaced, this can be done without the necessity of loosening the screw connectors holding the wires inside the unit. The fins employed may vary indefinitely and so may the configuration so that the required amount of heat is dissipated under varying service requirements. The connector or block is a heat sink in that the fins are formed integrally therewith and dissipate the heat from a confined area of material.

The fins have been found to be effective in dissipating the required temperatures from the metal of connectors or blocks between the area where the wires enter the connectors or blocks and where the tangs of the fuses are connected to the connectors or blocks.

The spacing of the fins is critical as is their thickness and height. Likewise the integral formation of the fins with the connector or block and extent across the width of these members is also critical.

By using fins, the overall length of the fuse holder can be reduced over the usual construction.

Various modes of carrying out the invention are contemplated as being within the scope of the following claims particularly pointing out and distinctly claiming the subject matter which is regarded as the invention.

We claim:

1. A fuse holder of the pressure type construction for use with fuses of varying amp capacity with heat being generated in the fuse holder in service which is required to be dissipated, which comprises a support, a pair of longitudinally spaced pressure connector blocks secured to said support, a generally small size fuse disposed in the space between the connector blocks and having tangs projecting from opposite ends and overlying the connector blocks, means extending through the tangs and into the connector blocks to secure the tangs to the connector blocks, at least one opening at the outer ends of the connector blocks disposed to receive electric wires to complete a circuit through the connectors and fuse, means securing the wires in place against the inside walls of the respective connectors, and at least one fin integrally formed with each connector block and projecting upwardly from each connector block at a location between a respective tang and the respective means securing a wire to a connector block to thereby dissipate heat from the metal area of each connector block between the fuse and the wire connections, said fin being approximately one-sixteenth of an inch in width and of a height to project to a horizontal plane extending vertically outwardly from a horizontal plane extending through the horizontal center line of the fuse and extending completely across the width of the connector block.

2. The fuse holder of claim 1, and wherein the fins are of a plurality in number and are spaced apart approximately from 3/16 to 7/32 of an inch.

3. The fuse holder of claim 2, and a plurality of fins integrally formed with the connector blocks extending downwardly within the connector blocks to a horizontal plane extending through the bottom surface of each connector block.

4. The fuse holder of claim 1, and the means extending through the tangs to secure the tangs to the connector blocks being screws having generally large heads, and cone-shaped, large metal washers disposed under each screw to maintain a tension between each head and tang to hold the tang securely against the connector block under different conditions of expansion and contraction of the metal due to heating and cooling of the metal.

5. The fuse holder of claim 1, wherein one of the connector blocks is a distribution block and receives a plurality of wires to carry electric current through the fuse holder.

6. The fuse holder of claim 2, in which each connector block is of stepped construction and the fins vary in height but terminate in the same horizontal plane.

7. The fuse holder of claim 1, and the means extending through the tangs to secure the tangs to the connector blocks being a stud and nut, and cone-shaped large metal washers disposed under each nut to maintain a tension between each head and tang to hold the tang securely against the connector block under different conditions of expansion and contraction of the metal due to heating and cooling of the metal.

* * * * *